United States Patent [19]

Gano et al.

[11] Patent Number: 4,582,134

[45] Date of Patent: Apr. 15, 1986

[54] WELL PACKER

[75] Inventors: John C. Gano; Donald H. Perkins, both of Carrollton, Tex.

[73] Assignee: Otis Engineering Corporation, Dallas, Tex.

[21] Appl. No.: 685,627

[22] Filed: Dec. 24, 1984

Related U.S. Application Data

[62] Division of Ser. No. 481,330, Apr. 1, 1983, Pat. No. 4,512,399.

[51] Int. Cl.[4] ..... E21B 23/00; E21B 23/06

[52] U.S. Cl. ..... 166/120; 166/217

[58] Field of Search ..... 166/206, 207, 212, 216, 166/217, 138, 140, 120; 285/18, 222, 223

[56] References Cited

U.S. PATENT DOCUMENTS

| | | | |
|---|---|---|---|
| 2,880,806 | 4/1959 | Davis | 166/217 |
| 3,749,167 | 7/1973 | Young | 166/217 |
| 3,991,826 | 11/1976 | Baugh | 166/217 X |
| 4,441,553 | 4/1984 | Setterberg, Jr. et al. | 166/217 X |

*Primary Examiner*—Stephen J. Novosad
*Assistant Examiner*—Thuy M. Bui
*Attorney, Agent, or Firm*—Roland O. Cox

[57] ABSTRACT

A hydraulically set retrievable well packer, with dual mandrels connectable into well tubing, for sealing the tubing to and anchoring the packer body in well casing utilizing a unique C-ring slip anchoring system. The mandrels are slidably connected for limited longitudinal movement in the packer body, which eliminates tubing spacing-out and temperature length change problems. There is a separate mandrel through the packer body for conducting flow from the casing annulus below the set packer. An internal lock system is provided to retain the packer in set position. If tubing parts above the set packer, the mandrels are supported and metal-to-metal sealed in the packer preventing tubing below the packer from falling. The packer may be retrieved by cutting one or both mandrels above the packing elements and picking up to release an internal connector which allows the slips and packing element to retract and the packer to be retrieved from the well. The anchoring, sealing and releasing means of this invention may be readily adapted for use on a single or multiple mandrel well packer.

9 Claims, 25 Drawing Figures

FIG. 5
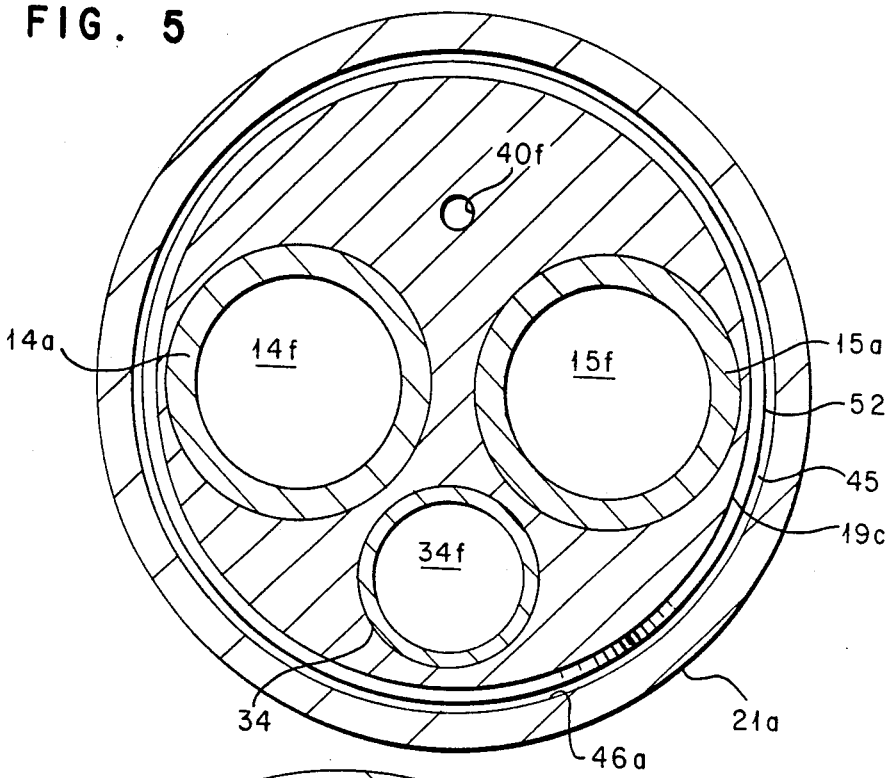
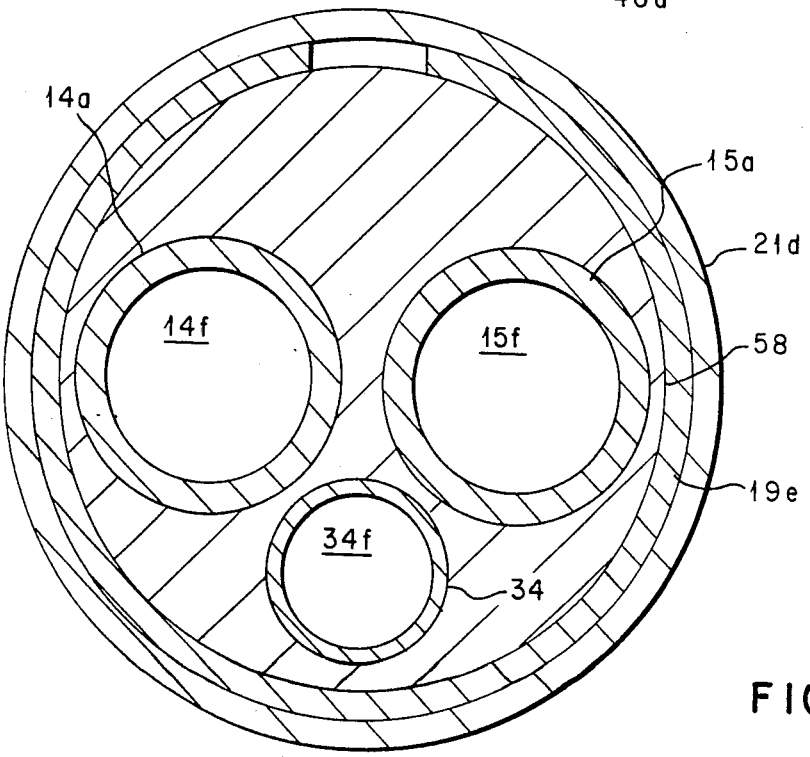
FIG. 6

WELL PACKER

This application is a division of our co-pending application Ser. No. 06/481,330 filed April 1, 1983, now U.S. Pat. No. 4,512,399.

BACKGROUND OF THE INVENTION

This invention pertains to packers used in earth wells and particularly to a hydraulically set retrievable packer having dual mandrels and a novel slip anchoring system.

A similar well packer is disclosed and claimed in U.S. application Ser. No. 372,138 filed April 27, 1982. Both the packer of this invention and the packer of the aforementioned application can be utilized in the WELL FLOW CONTROL SYSTEM AND METHOD disclosed in U.S. Pat. No. 4,077,472 to John C. Gano. Numerous operational and safety requirements of prior well flow control systems of this type require numerous complicated, costly and often large downhole equipment packages and components.

The packer of this invention can be very effectively used to replace slip joints, the casing hanger nipple, the casing hanger, the hanger packer and the tubing hanger of the previously mentioned patented well flow control system and provide further benefits when utilized in that system or in similar well flow systems.

Those skilled in slip anchoring system art should readily recognize that the system utilized on the well packer of this invention could be used to anchor a variety of well tools in wells.

SUMMARY OF THE INVENTION

This invention comprises a pair of sectioned mandrels connectable into well tubing strings whereon is mounted a sectioned mostly tubular body around which is slidably mounted a sectioned tubular outer body. The body and outer body are releasably connected by pins.

Two of the body sections are connected together by a longitudinally cut cylinder (C-ring) having tapered male threads on both ends. This C-ring is propped in the expanded position wherein the male threads engage female threads in the bottom of one body section and the top of another body section connecting them together. The prop is releasably connected to an upper body section with pins.

The slip anchoring system includes very coarse generally buttress form male threads or nonhelical grooves on the lower end of the outer body, loosely engaged in mating internal threads or grooves in almost one-half of a C-ring slip cylinder with two opposed sets of teeth cut on the outside. Internal threads or grooves in almost all the other half of the C-ring slip are engaged on mating male threads (grooves) on an expander slidably mounted around the lower body.

Near the top of the packer, the two mandrels are releasably connected in the body. Mounted on the lower body between the lower end of the expander and a shoulder on the lower body is a packing element. Disposed in an annulus between the upper body and upper outer body are seal mandrels or pistons useful in setting the packer after it has been lowered to setting depth in the well on tubing. Hydraulic pressure may be applied from the surface on the setting pistons through a control line and internal passages to shear the connecting pins and move the outer body downward longitudinally to set the packer.

Disposed between the body and outer body is a slip lock which permits downward longitudinal movement of the outer body relative to the body and prevents upward relative movement therebetween to maintain the packer set. Each mandrel is slidably sealed to the lower body with resilient seals in the body.

A third auxiliary mandrel, which may be connected to tubing extending above the packer, extends into the packer and is connected to the top of the lower body providing a flow passage from below to above the set packer.

Each of the two main mandrels is provided with a section, at the proper level within the packer, wherein either or both sections may be cut to initiate retrieval of the packer. Before cutting the mandrels, each may be picked up to raise bottom sections, each having an upper outer bearing surface, up to engage bearing surfaces on the lower end of the lower body section, stopping upward travel of the mandrels. The lower end of each of the cut mandrel sections has a support surface which may be lowered in a set packer to engage a mating support surface on the upper end of the lower body, which also metal-to-metal seal in addition to the resilient seal between mandrel and lower body. The mandrel sealing support and lower body sealing support surfaces engage to seal and support when the mandrels are lowered in the packer by tubing weight or when either one or both mandrels are cut and suspended tubing weight pulls the lower portions of the cut mandrels down to be supported and sealed.

After cutting either or both mandrel cut sections, picking up tubing and upper portion of the cut mandrel section raises a shoulder on the upper mandrel section to engage the lower end of the prop. Further upward movement of the mandrel will shear pins positioning the prop in the upper body, moving it upwardly from inside the expanded C-ring connector. The C-ring contracts, disconnecting the body sections and continued upward movement of the tubing and mandrel unsets the packer for retrieval from the well casing.

An object of this invention is to provide a hydraulic set well packer, connectable in tubing, which replaces numerous complicated components in well flow control systems.

A second object of this invention is to provide an improved well packer which may be mounted on one or more mandrels.

Another object of this invention is to provide a well packer wherein the mandrel(s) may be moved longitudinally in the set packer to eliminate tubing temperature change and spacing-out problems.

Another object is to provide a well packer from which tubing may be suspended if tubing above the packer is parted.

Another object of the present invention is to provide a well packer having a flow passage from the tubing-casing annulus below the set packer to the annulus above.

Also, an object of this invention is to provide a well packer having a novel slip anchoring system.

BRIEF DESCRIPTION OF THE DRAWINGS

FIG. 5 is a cross-section along lines 5—5 of FIG. 1.

FIG. 6 is a cross-section along lines 6—6 of FIG. 1.

DESCRIPTION OF THE PREFERRED EMBODIMENT

Figure 1A:
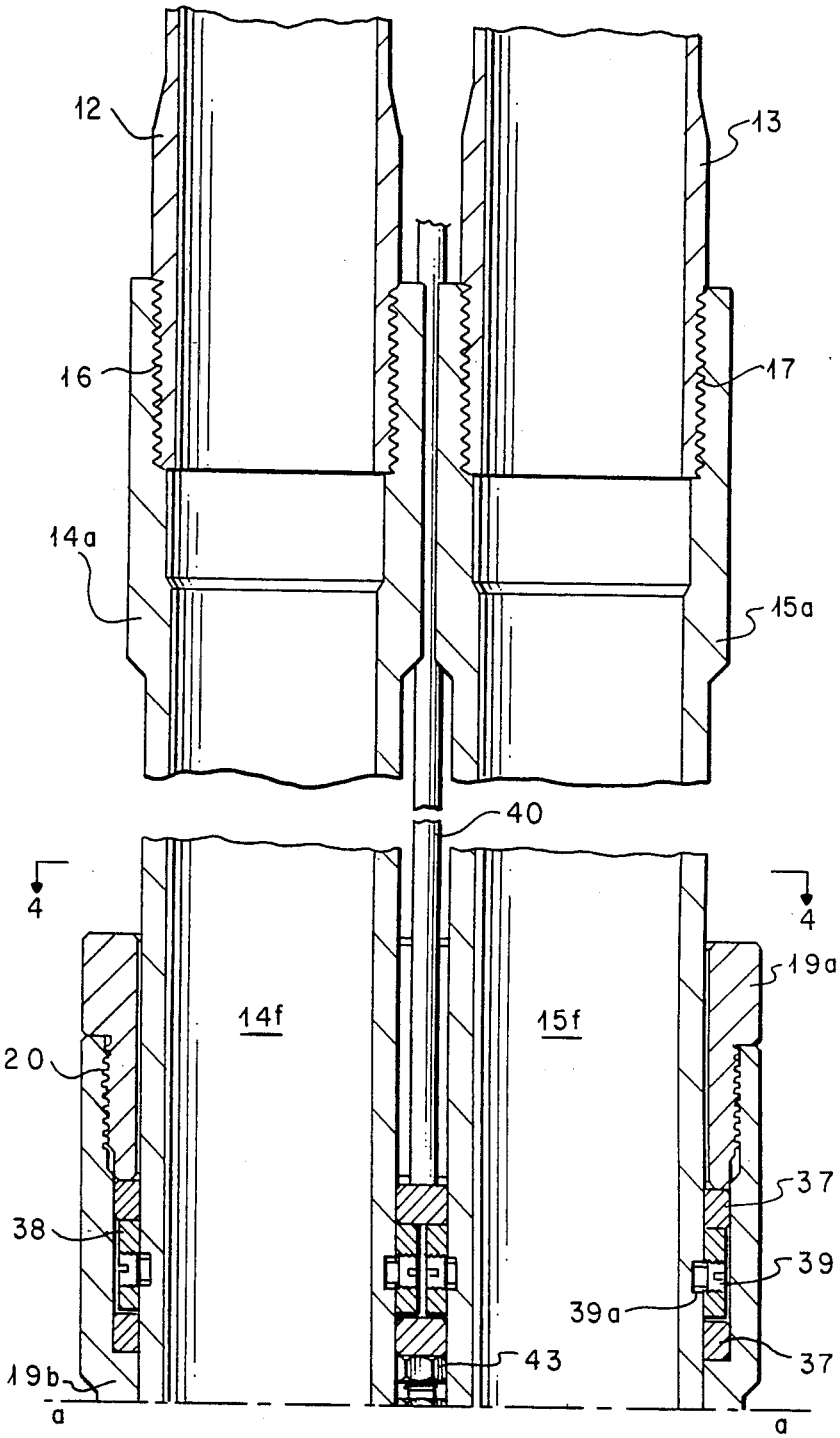
FIGS. 1A–1I together are a sectioned drawing of the invention packer in elevation being lowered into a well.
Figure 1B:
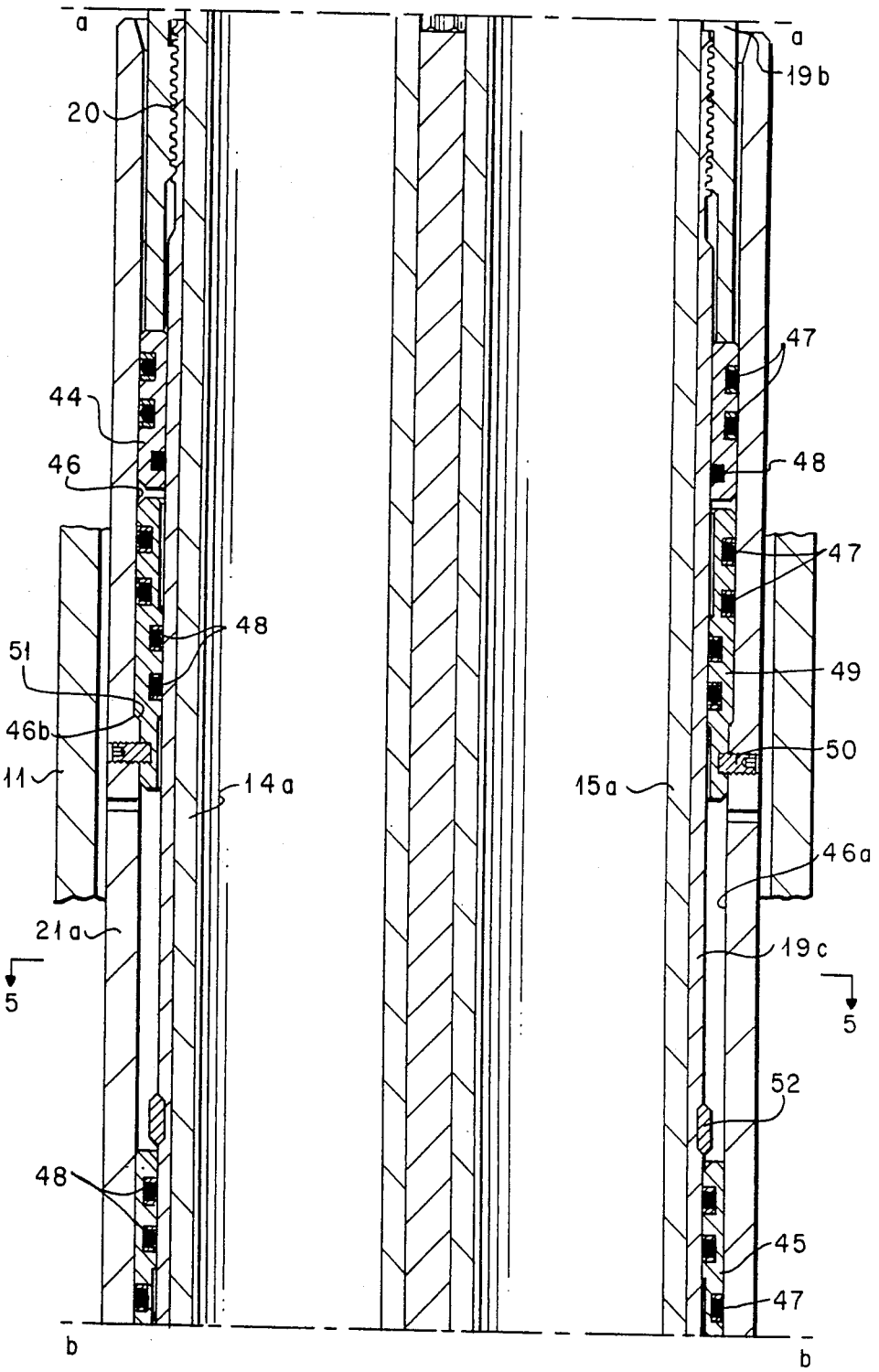
Figure 1C:
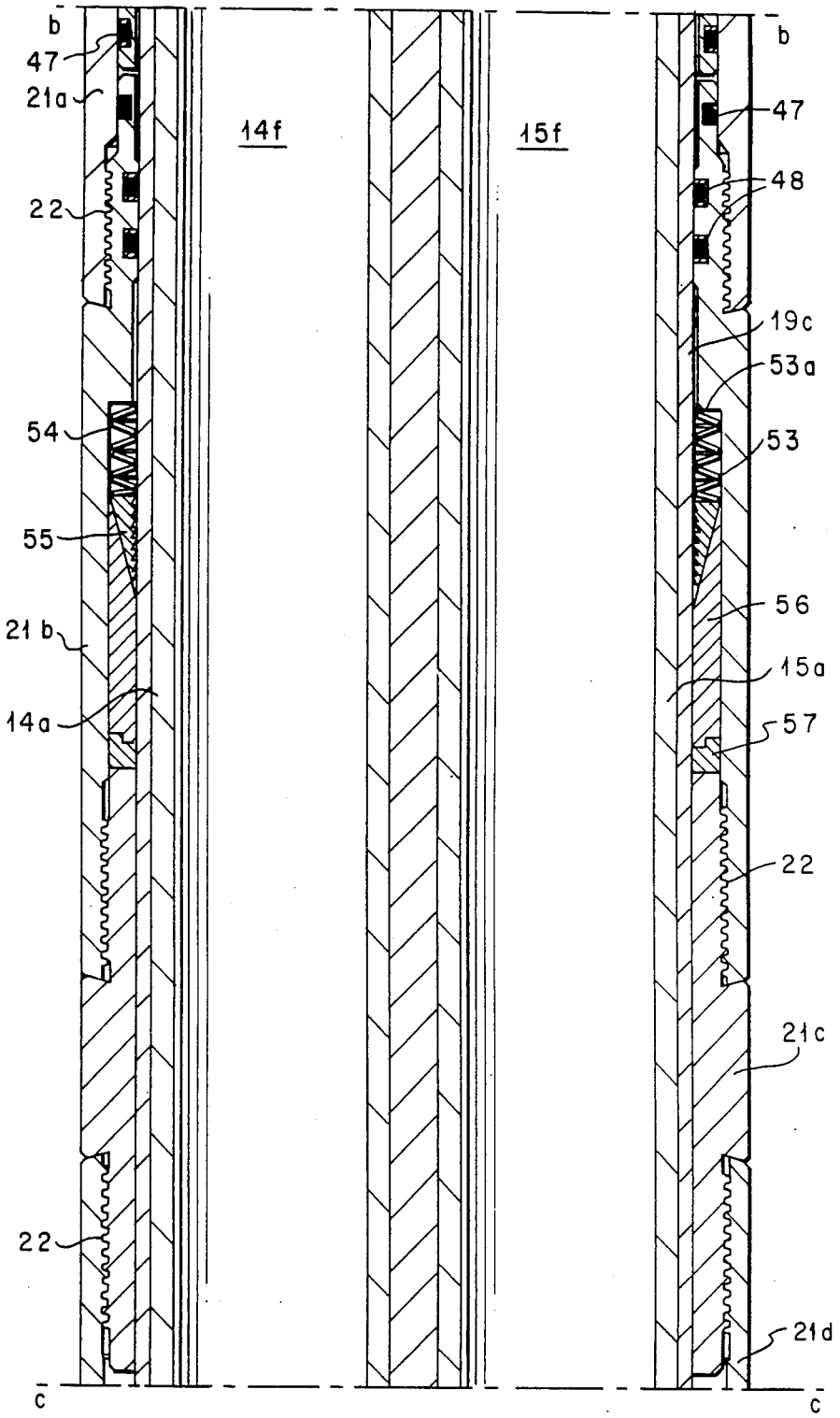
Figure 1D:
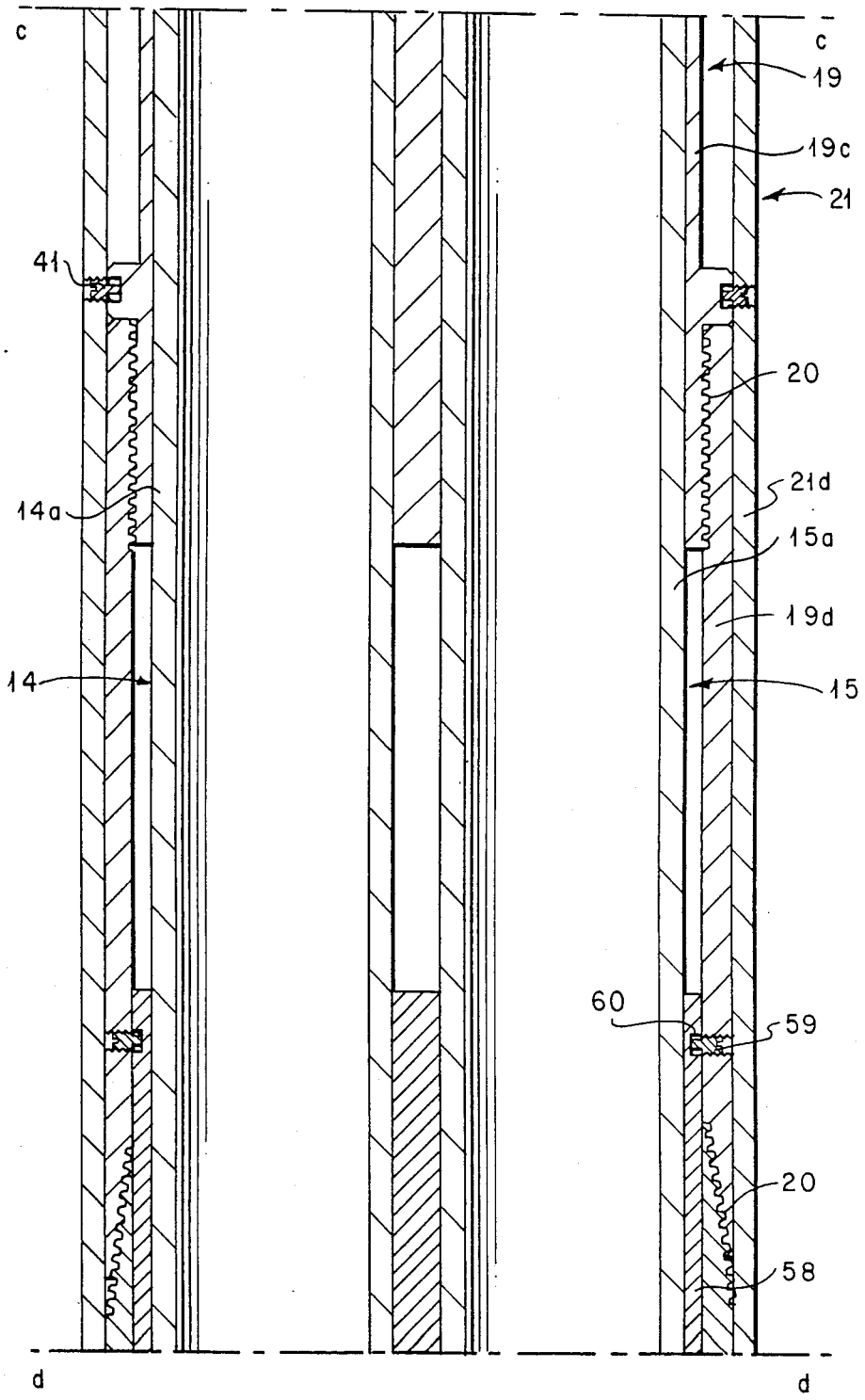
Figure 1E:
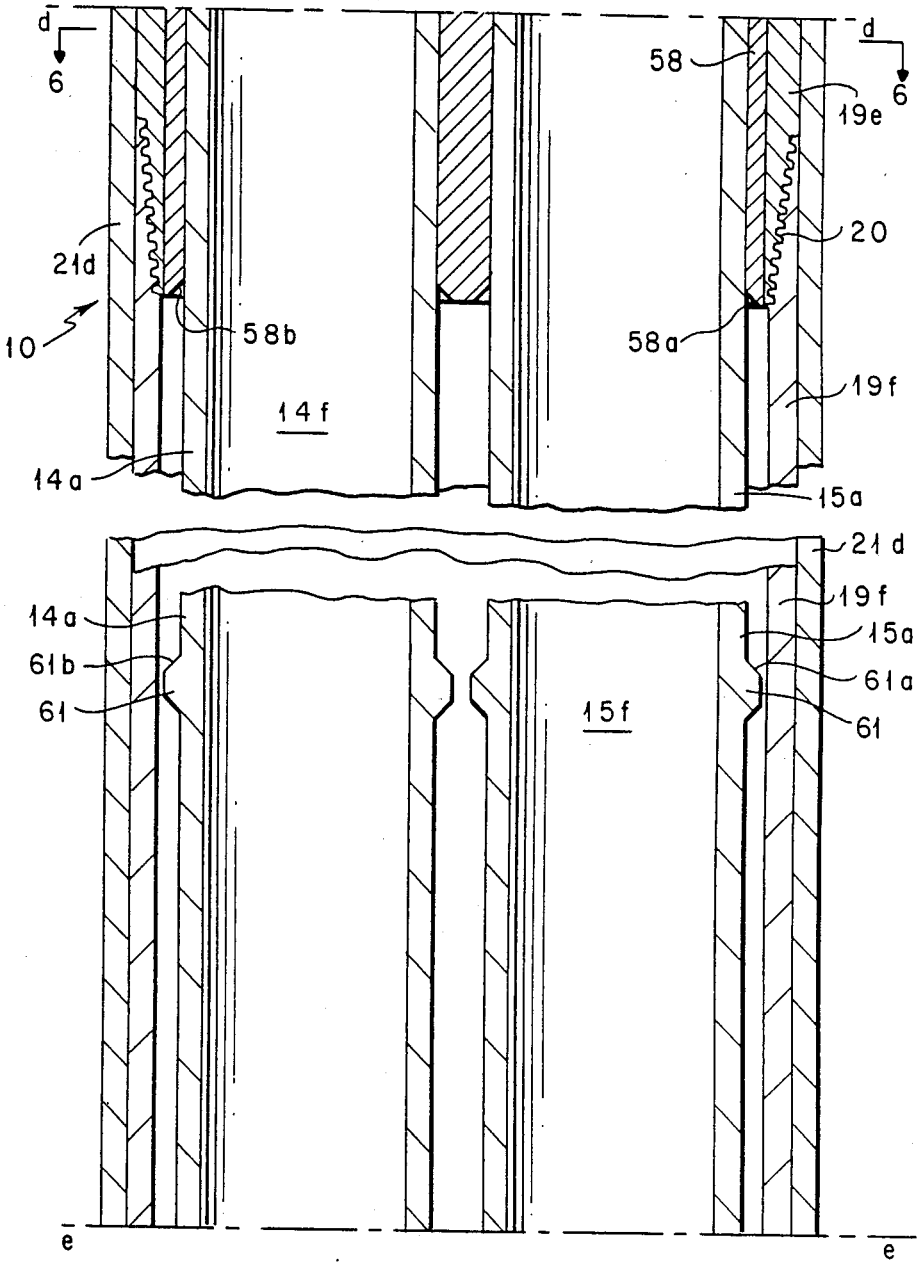
Figure 1F:
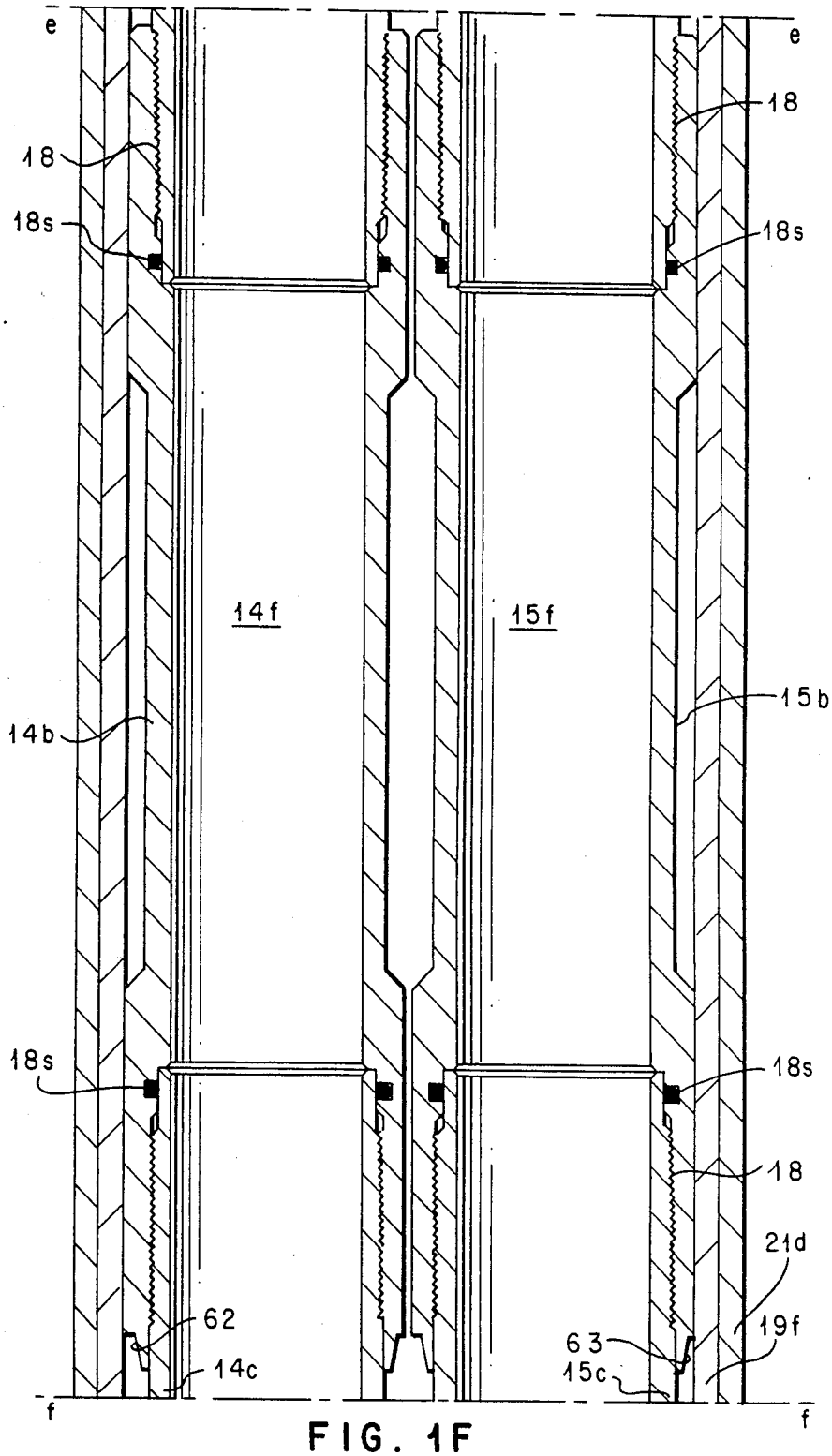
Figure 1G:
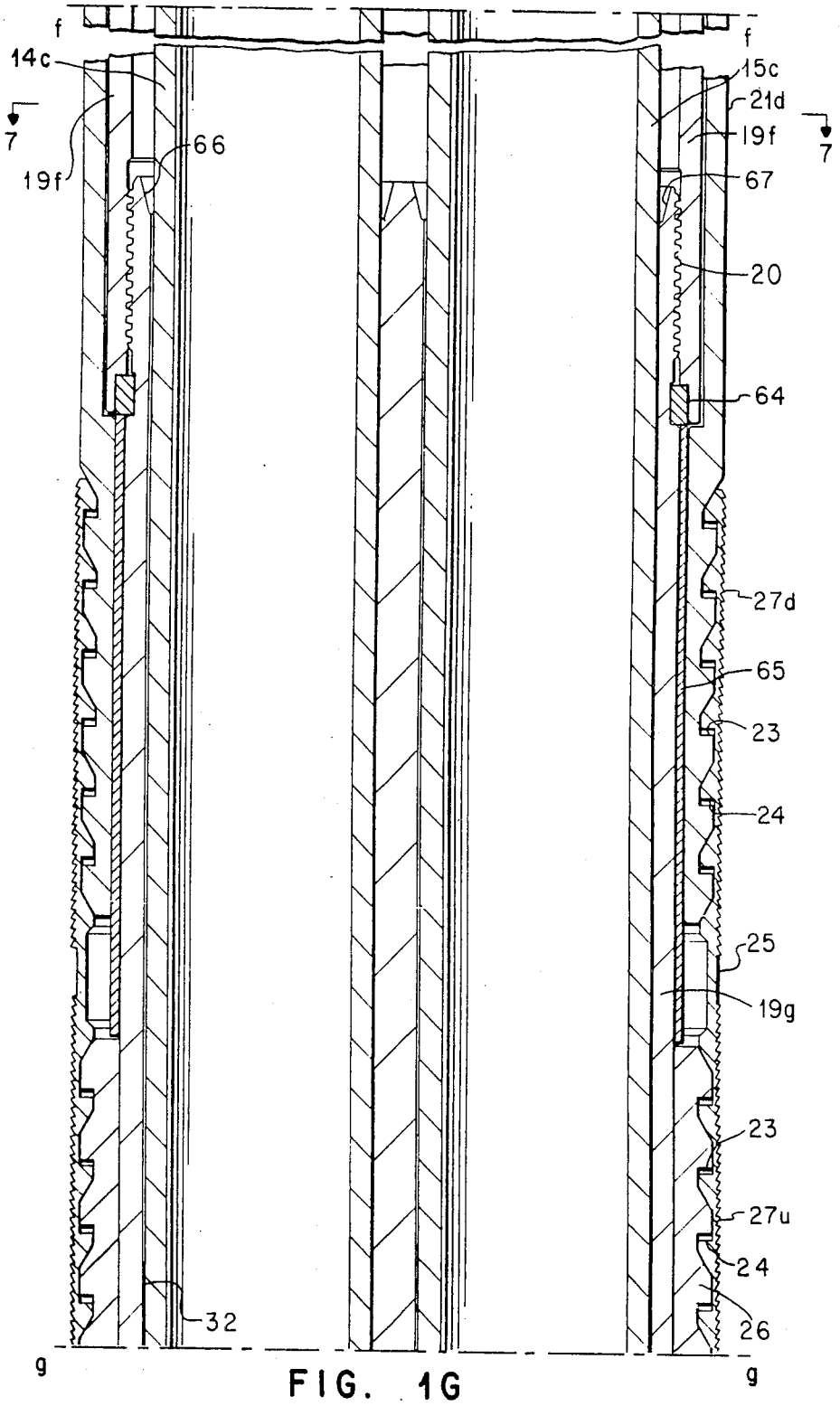
Figure 1H:
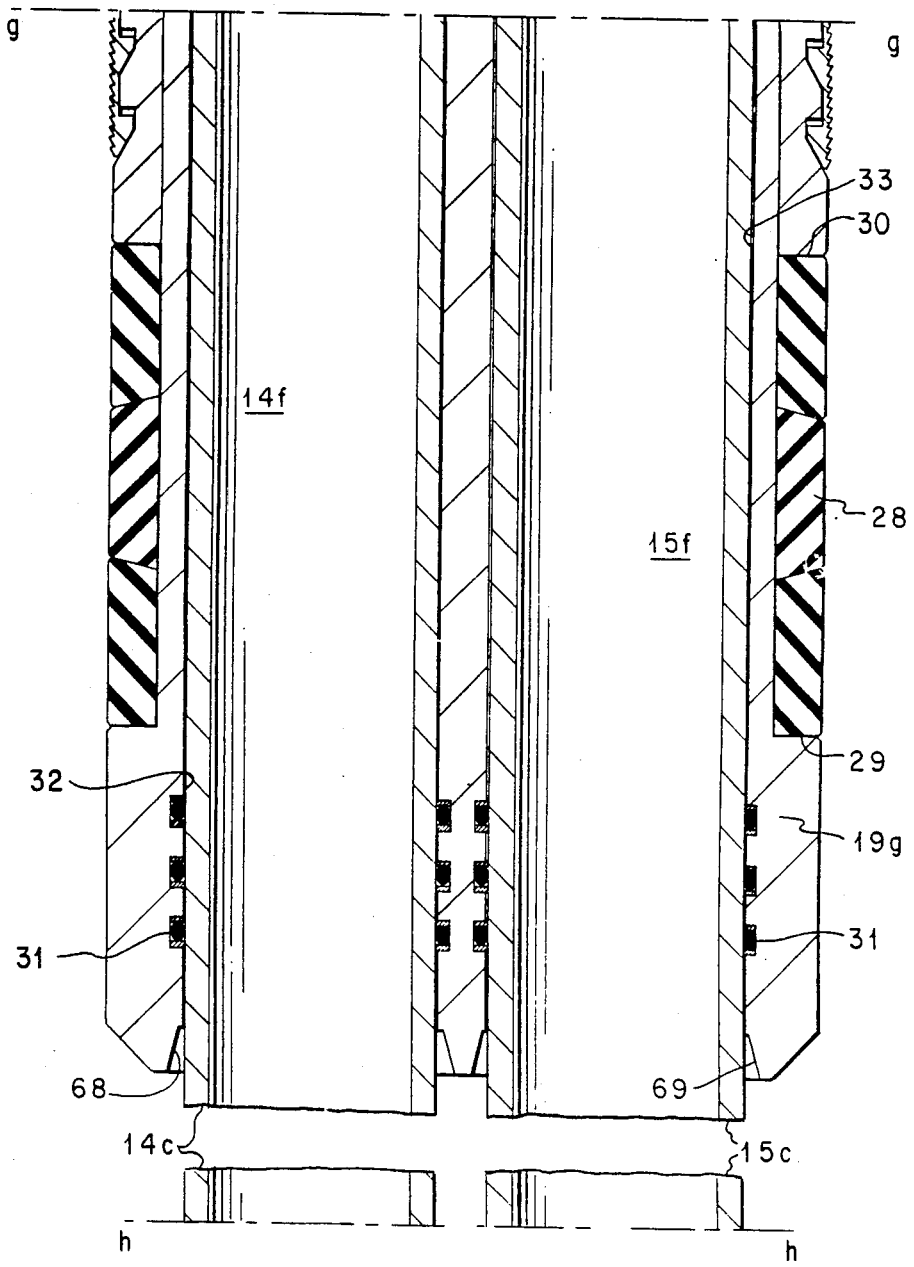
Figure 1I:
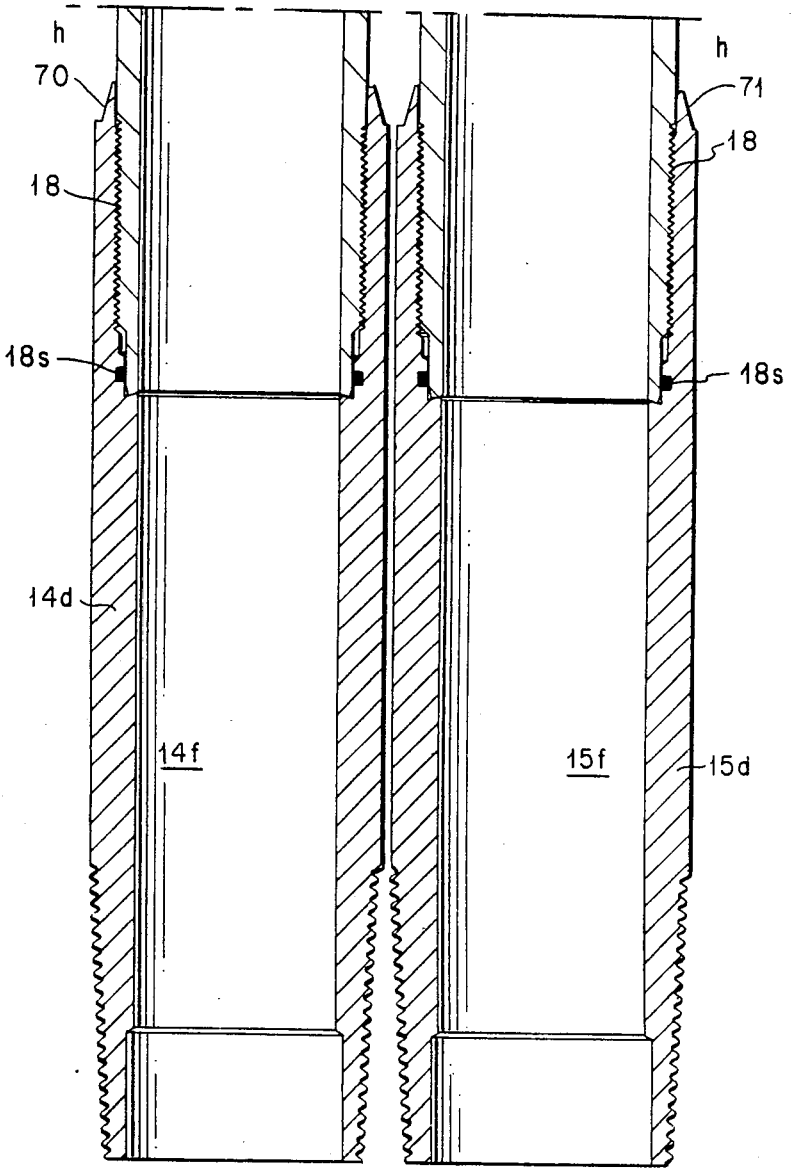

FIG. 1 shows the preferred embodiment of well packer 10 of the present invention, as it would be lowered into an earth well casing 11 on tubing strings 12 and 13 attached to tubular packer mandrels 14 and 15 by threaded connections 16 and 17. The tubing strings usually extend upwardly and are attached to the lower end of a tubing hanger in the wellhead (not shown). Each packer mandrel has a number of sections, 14*a*–14*d* and 15*a*–15*d*, which are connected with appropriate threads 18 and sealed with resilient seals 18*s*. Each mandrel has a longitudinal flow passage, 14*f* and 15*f*, therethrough. Both main mandrels are housed in a generally cylindrical body 19 having a number of sections, 19*a*–19*g*, connected wth appropriate threads 20.

Surrounding the body is an outer body 21, again having a number of sections, 21*a*–21*d*, connected with threads 22. On the lower end of outer body section 21*d* are cut male threads or grooves 23 generally of a buttress thread form. Engaged with male expanding threads or grooves 23 are loosely mating female threads or grooves 24 cut on the inside from one end of a cylinder cut longitudinally through one wall to form a C-ring slip 25. The inside of the C-ring cylinder is threaded or grooved from the other end with more threads or grooves 24 loosely mating with more male threads or grooves 23 cut on expander 26, so that C-ring slip 25 is connected by threads or grooves to expander 26 and to outer body section 21*d*. Formed on the outside of cylinder 25 are two opposed sections of teeth 27*d* and 27*u*. The upper section of teeth 27*d* are formed to resist forces tending to move C-ring slip 25 downwardly and the lower sectin of teeth 27*u* are formed to resist forces tending to move the slip 25 upwardly when the slip is expanded and teeth 27*d* and 27*u* engage the inside of the well casing. A three ring packing element 28 is disposed around body section 19*g* abutting shoulder 29 near the lower end of body 19*g*. The lower end face 30 on expander 26 abuts the upper end of the packing element. Resilient seals 31 seal the outside of mandrels 14 and 15 in longitudinal bores 32 and 33 respectively through lower body 19*g*. Connected to the lower end of mandrel sections 14*c* and 15*c* with threads 18 sealed by resilient seals 18*s*, are connectors 14*d* and 15*d*, each having a thread on its lower end for connection of tubing.

Figure 3A:
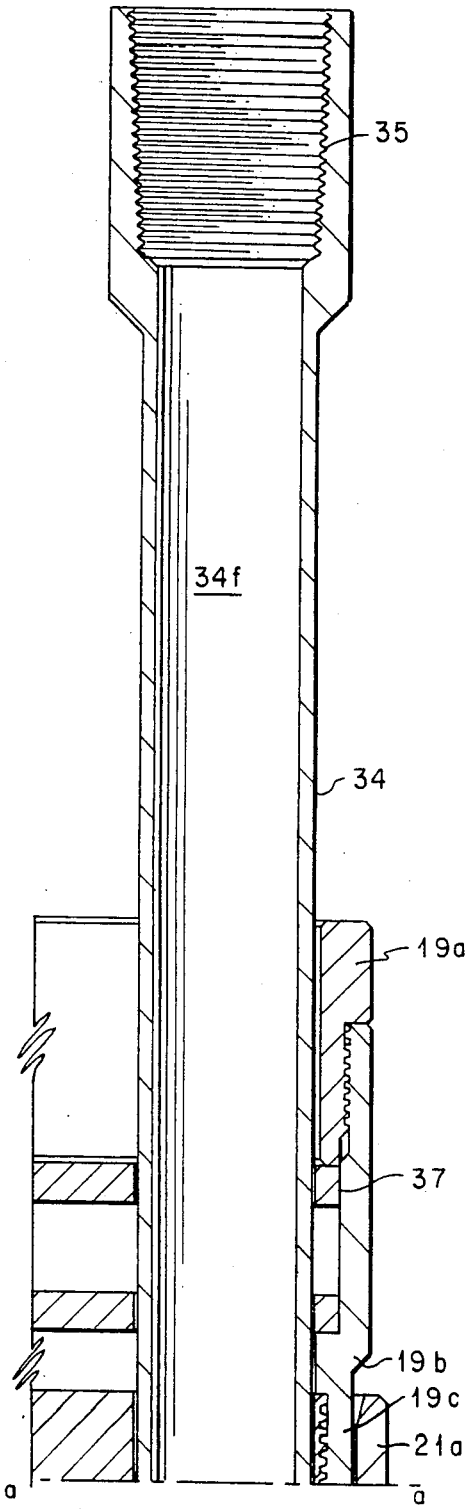
FIGS. 3A and 3B are partial cross-sections along line 3—3 of FIG. 4 showing the third mandrel and flow passage from below to above through the invention packer.
Figure 3B:
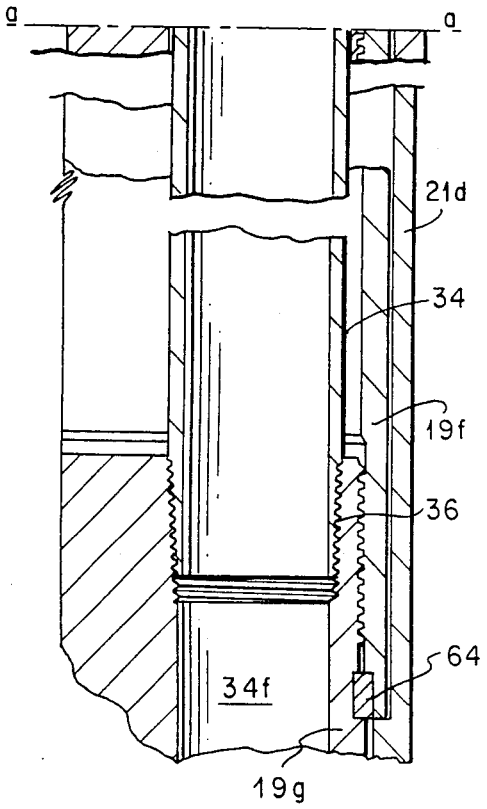
Figure 4:
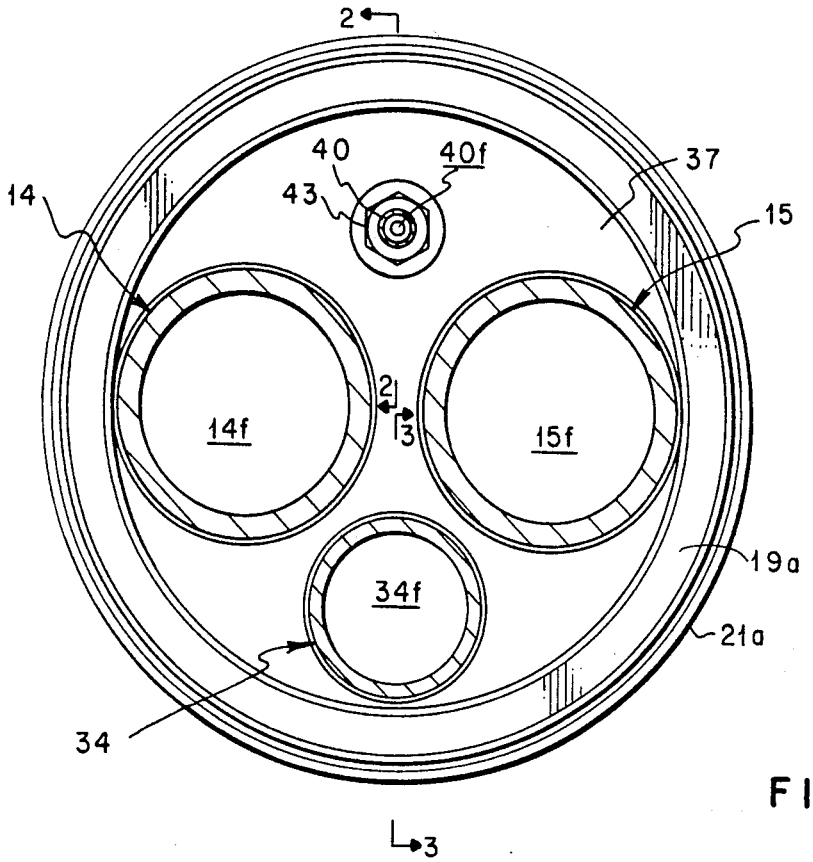
FIG. 4, is a cross-section along line 4—4 of FIG. 1 showing the angular spacing of the mandrels and control line.
Figure 7:
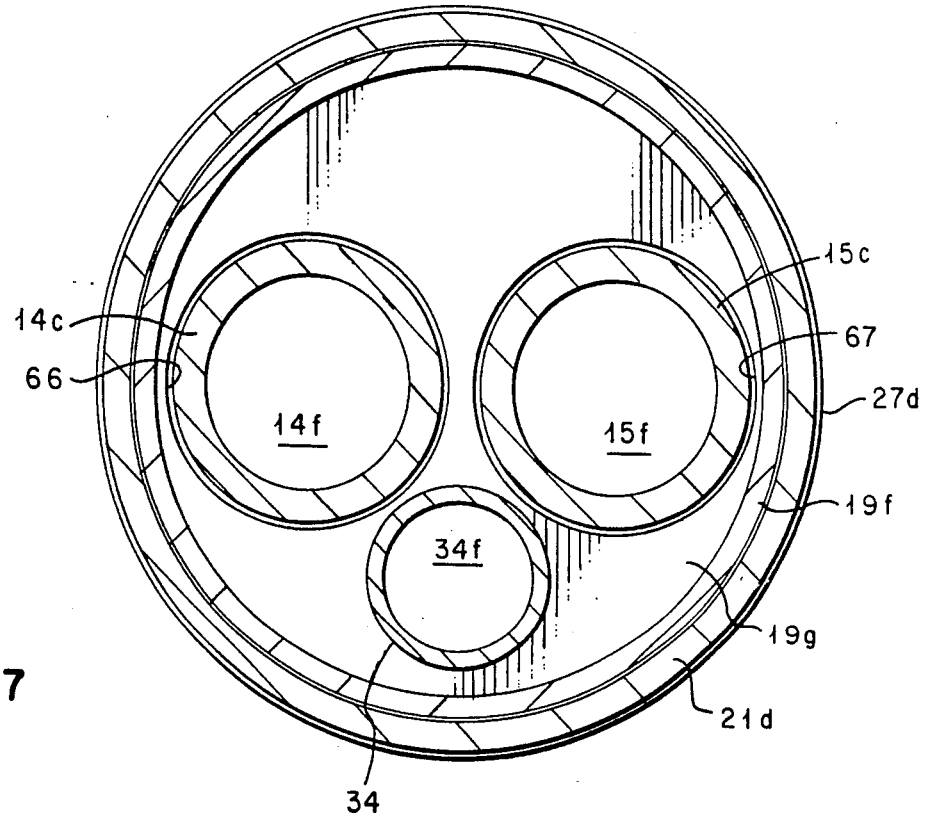
FIG. 7 is a cross-sectional drawing along line 7—7 of FIG. 1.

In addition to longitudinal flow passages 14*f* and 15*f* through mandrels 14 and 15, there is provided a third longitudinal flow passage 34*f* (FIG. 3) through third mandrel 34 and lower body 19*g*. This third mandrel has an appropriate top thread 35 for connection of tubing, and extends through holes in plates 37, body 19*c* and prop 58, and is connected into the top of the lower body 19*g* with sealing thread 36. Tubing connected at thread 35 communicates with the annular region below the set packer through passage 34*f*.

Near the top of the invention packer, plates 37 are positioned above and below rings 38 through which are threaded shear screws 39 which protrude into holes 39*a* in upper main mandrels 14 and 15 releasably attaching the rings to the mandrels. The plates and rings are retained in a top bore in body section 19*b* by body 19*a* connected thereto with threads 20.

Figure 2A:
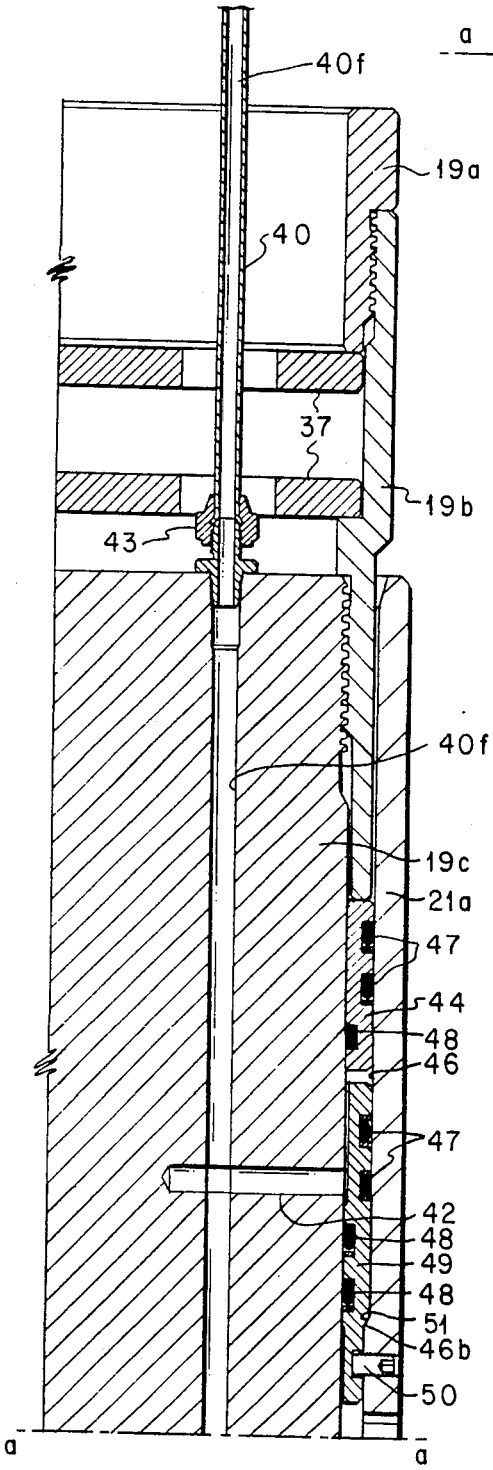
FIGS. 2A and 2B are partial cross-sections along line 2—2 of FIG. 4, showing the hydraulic setting means of the packer of this invention.
Figure 2B:
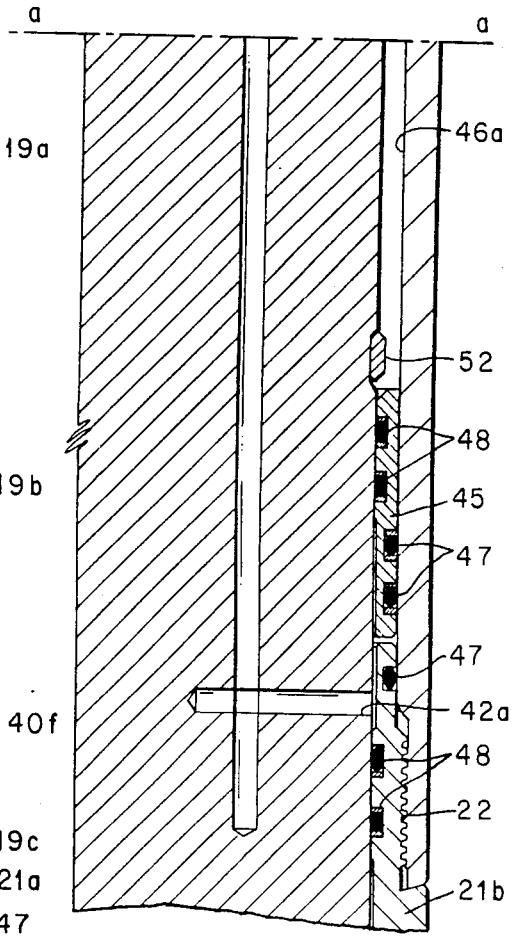

Passing through a hole in each plate 37, FIG. 2, is a control line 40 having a flow passage 40*f* and extending upwardly to a hydraulic pressure source. The lower control line end is connected into the top of body 19*c* with connector 43, to communicate flow passage 40*f*, internal flow passages 42 and 42*a*.

Disposed around upper body 19*c* and in upper outer body 21*a* are a pair of annular seal mandrels 44 and 45. These mandrels are mounted in outer body bores 46 and 46*a* and are sealed thereto with resilient seals 47. Mandrels 44 and 45 are sealed on their insides to the outside of body 19*c* with resilient seals 48. Also disposed around body 19*c* and in outer body bore 46, below mandrel 44, is annular setting piston 49 sealed outside to bore 46 with resilient seals 47, slidably sealed inside to body 19*c* with resilient seals 48 and positioned with screws 50 so outside piston tapered shoulder 51 engages body bore tapered shoulder 46*b*. Mounted in a groove around the outside of body 19*c* above piston 45 is a ring 52 limiting upward travel of the piston.

Another seal ring 47 seals outer body sections 21*a* and 21*b* at thread 22 therebetween. The upper inside of outer body section 21*b* is slidably sealed to the outside of body section 19*b* with resilient seals 48 housed in 21*b* adjacent thread 22 between sections 21*a* and 21*b*. Housed in a bore 53 in outer body section 21*b* are a number of spring washers 54 which exert a longitudinal force on internal bore shoulder 53*a* and the upper end of slip segments 55, urging the segments downwardly and inwardly (along the tapered surface on the upper end of bowl 56) to bite section 19*c*. The bowl is supported by split ring 57 abutting the top end of body section 21*c*. Outer body section 21*c* is connected to section 21*b* by upper thread 22 and section 21*d* with lower thread 22.

Housed in the annular space between outer body section 21*d* and mandrel section 15*a* is an enlarged lower end section of body 19*c* connected to the upper end of body section 19*d* with thread 22. The enlarged lower section of body 19*c* is releasably connected to outer body section 21*d* with screws 41. Section 19*d* is releasably connected to prop 58 with screws 59 threaded through 19*d* and protruding into a groove 60 in the prop. The lower end of the prop is provided with two bearing surfaces 58*a* and 58*b*. Cut cylinder (C-ring)

body section 19e surrounds and is propped out by prop 58, engaging male tapered threads 20 on both ends with mating female threads 20 connecting the lower end of body section 19d with the upper end of section 19f.

Mandrel sections 14a and 15a, each having shoulders 61 with bearing surfaces 61a and 61b, extend downwardly and are connected to the top of tubular mandrel sections 14b and 15b, respectively, by thredes 18 which are sealed with resilient seals 18s. Mandrel sections 14b and 15b are provided with longitudinal flow passages 14f and 15f and lower sealing support surfaces 62 and 63. The lower ends of mandrel sections 14b and 15b are connected to the upper ends of sections 14c and 15c inside cylindrical body section 19f which is concentrically disposed in outer cylindrical body section 21d. The lower end of section 19f is threadedly attached to the upper end of section 19g with thread 20. A split ring 64 is retained in a groove around the upper end of 19g by a bore in the lower end of 19f, which provides an upper shoulder positioning 19f on 19g and a lower shoulder retaining sleeve 65 slidably disposed around section 19g between the lower shoulder on ring 64 and the upper end of expander 26, which is also slidably disposed around section 19g. On the upper end of longitudinal bores 32 and 33 are sealing support surfaces 66 and 67 and on their lower ends are bearing surfaces 68 and 69. Bearing surfaces 70 and 71 are also provided on the upper ends of mandrel sections 14d and 15d.

To install and set the packer 10 of the present invention, connect the packer into the tubing strings, connect tubing to the upper end of third mandrel 34 (if required) and control line to connector 43 and lower the packer to desired setting depth. Connect the control line to an appropriate source of pressurized fluid at the wellhead and apply pressure down flow passage 40f, internal flow passage 40f in body section 19c and passages 42 and 42a, FIG. 2, to act simultaneously on annular setting piston 49 and the sealed by seals 47 and 48 annular area between bore 46a and the outside of body section 19c on the upper end of outer body section 21b. As upward movement of seal mandrel 44 is stopped by the lower end of body section 19b and upward movement of seal mandrel 45 is prevented by ring 52 on section 19c, increased control line pressure acting on the setting piston and annular end area will move setting piston 49 and connected outer body sections 21a, 21b, 21c, and 21d downward with reference to connected body sections 19a, 19b, 19c, 19d, 19e, 19f and 19g shearing screws 41. The buttress threads or non-helical grooves 23 on the lower end of outer body section 21d move down in the mating threads (grooves) 24 in slip cylinder 25 camming and expanding the cylinder and moving it down over expanding threads or grooves 23 on expander 26 until teeth 27d and 27u travel out, contact and penetrate the inside surface of casing 11. Expander 26 may move down at this time, compressing packing element 28 between lower end face 30 and shoulder 29 on body section 19g, partially expanding the packing element outwardly for sealing contact with the inside of the well casing. When the slip teeth 27d penetrate the casing sufficiently to stop down movement of outer body section 21d, further increases in control line pressure now act upwardly underneath seal mandrels 44 and 45 to lift the lower end of body section 19b and ring 52 on section 19c, moving connected body sections 19a–19g upwardly to further compress element 28 between face 30 and shoulder 29. The expander is prevented from moving upwardly by "set" slip teeth 27u. More upward movement of body 19 compresses the element to completely expand into sealing engagement with the inside of the well casing and possibly forces teeth 27u deeper into the casing wall. The packer 10 of the present invention is now "set", i.e., securely attached to the casing wall and sealing therewith as shown schematically in FIG. 8. After control line pressure is reduced, the total upward movement or "setting stroke" of sectioned body 19 relative to sectioned outer body 21 is retained by teeth on slip segments 55 penetrating the outside of body section 19c on downward movement into bowl 56.

Any tubing load or pull now applied to the set packer from above or below sufficient to shear screws 39 (FIG. 9) will move mandrels 14 and/or 15 upwardly or downwardly through seals 31 and body 19. Downward movement of the mandrels stops when sealing support surfaces 62 and 66 and/or 63 and 67 are engaged. Any down load on surface 66 (67) is supported by connected body sections 19 which transfer the load through slip segments 55 to connected outer body sections 21, via expanding threads (grooves) 23 and 24 into teeth 27d and well casing 11. Upward movement of the mandrels stops when bearing surfaces 70 and/or 71 are moved up and engage bearing surfaces 68 and/or 69. Any mandrel up load on surfaces 68 and/or 69 sufficient to move body section 19g and shoulder 29 upward, further compresses packing element 28. The resultant increased up force from the packing element on lower face 30 of expander 26 is transmitted through expanding threads or grooves 23 and 24 and teeth 27u into the casing wall, possibly causing deeper penetration of the teeth.

Figures 8A, 9A, 10A, 11A:
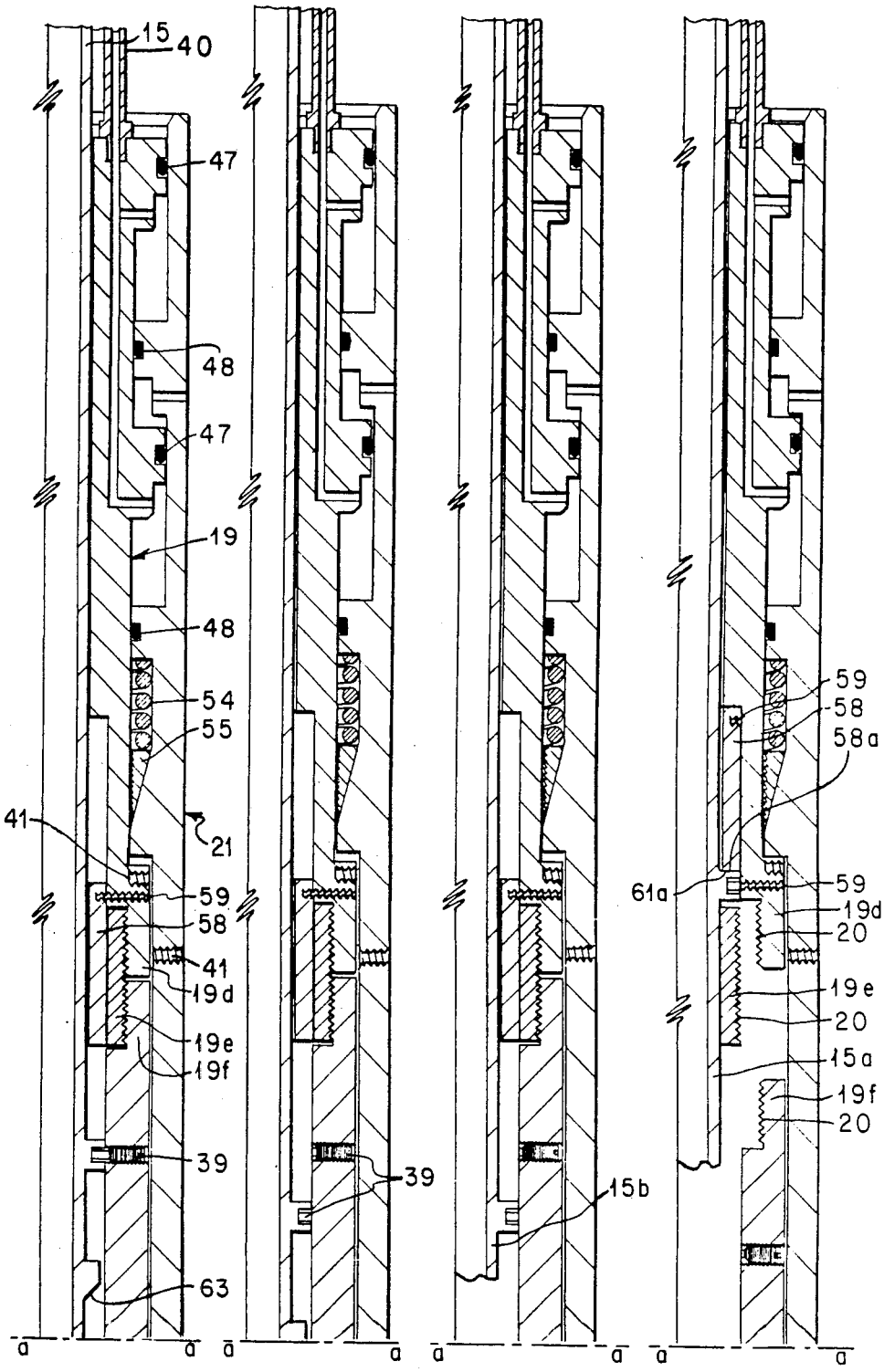
FIGS. 8A and 8B together are a schematic half-section drawing of the right half of the packer of this invention set (anchored and sealing) and locked set in a well casing.
FIGS. 9A and 9B together are a schematic drawing similar to FIG. 8 of the set invention packer wherein the mandrel has been released from the body and lowered.
FIGS. 10A and 10B together show schematically a set invention packer wherein the mandrel has been cut for retrieval and tubing below is suspended from the packer body.
FIGS. 11A and 11B are another schematic drawing similar to FIGS. 8, 9 and 10 showing the packer body disconnected, the C-ring slips retracted and the packing element retracted before retrieval of an invention packer from well casing.
Figures 8B, 9B, 10B, 11B:
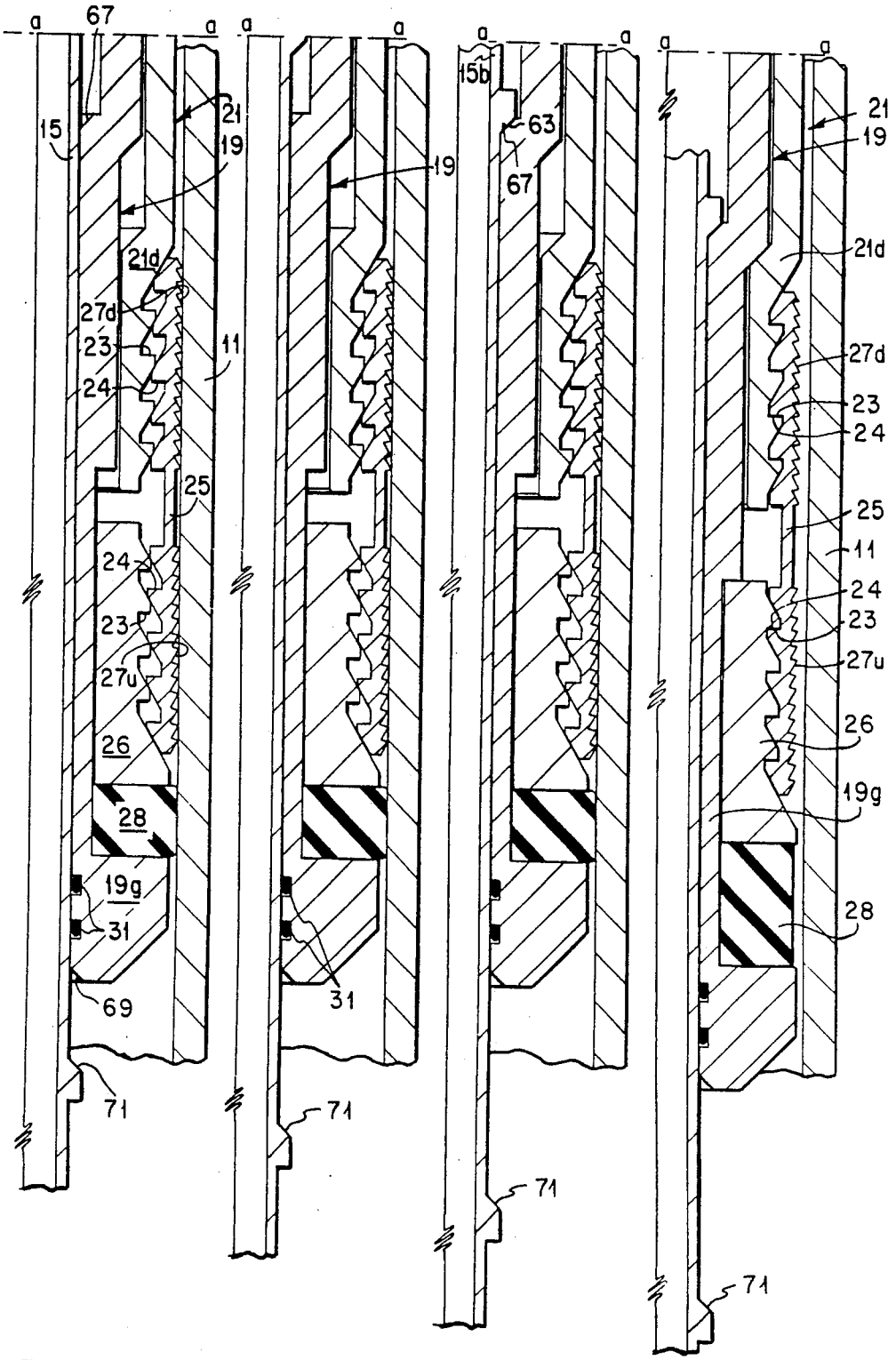

To release and retrieve the set packer, one or preferably both mandrel sections 14b and 15b must be cut between threads 18 as shown in FIG. 10. Immediately on cutting the mandrel section(s), the weight of any tubing suspended from the set packer on the mandrels will pull connected lower mandrel sections 14d, 14c, and the lower part of 14b (with seal support 62) and/or 15d, 15c and the lower part of 15b (with seal support 63) down engaging surfaces 62 and 66 and/or surfaces 63 and 67, sealing the mandrel(s) to body section 19g and supporting tubing weight on surfaces 66 and 67 on the upper end of section 19g. Now, mandrel 14 and/or 15 may be picked up with tubing from above the packer moving mandrel section 14a (with shoulder 61b) and/or mandrel section 15a (with shoulder 61a) up until these shoulders engage lower surfaces 58a and/or 58b on prop 58, FIG. 11. Greater upward pull on either or both mandrels will shear screws 59. Continued mandrel pull will move prop 58 up and out of split cylinder connector 19e allowing this connector to collapse inwardly, disengaging threads 20 on both ends, disconnecting 19e from body sections 19d and 19f. Continued tubing pull will move the mandrel and the upper end of the prop into contact with the lower end of section 19c. The shoulder on 19c moves upwardly contacting the lower end of 21c, lifting outer body 21. Upward movement of threads (grooves) 23 on the lower end of body section 21d in threads (grooves) 24 allows cut cylinder 25 to collapse disengaging teeth 27d and 27u and pulls expander 26 with face 30 up whereby packing element 28 may extend and retract out of sealing engagement with the well casing. The released packer shown in FIG. 11 may now be retrieved back to surface.

We claim:

1. An anchoring device for a well tool comprising:

a. an upper expander having male threads thereon engaging female threads in one end of a C-ring slip having upper and lower exterior teeth sections thereon; and b. a lower expander having male threads thereon engaging female threads in the other end of said slip, so that when said upper and lower expanders are moved toward each other, flank angles on the engaged threads cam the slip to expand and engage the teeth with the interior wall of a well pipe, to prevent upward or downward movement of the well tool and when said expanders are moved away from each other, said slip contracts disengaging said teeth from said wall.

2. The anchoring device of claim 1 wherein the upper teeth are formed to prevent downward movement of the anchoring device, and the lower teeth are formed to prevent upward movement of the anchoring device.

3. The anchoring device of claim 1 wherein the engaged threads are buttress in form.

4. The anchoring device of claim 1 wherein the height of the engaged threads is greater than the height of the exterior teeth on the slip.

5. An anchoring device for a tool comprising an expander threadedly connected in a C-ring slip having upper and lower teeth sections thereon and a second expander threadedly connected in the other end of said slip, whereby when said expanders are moved toward each other, said threaded connections cam said slip to expand and anchor said tool in pipe against upward or downward movement and when said expanders are moved away from each other, said slip contracts.

6. The anchoring device defined in claim 5 wherein the connecting threads are buttress in form.

7. The anchoring device of claim 5 wherein the height of the connecting threads is greater than the height of the slip teeth.

8. The anchoring device of claim 5 wherein the height of said grooves is greater than the height of said teeth.

9. An anchoring device for a tool comprising an expander, having non-helical grooves of a buttress thread form thereon, connected in one end of a C-ring slip having mating grooves in said end and upper and lower teeth sections thereon and a second expander, having non-helical grooves of a buttress thread form thereon, connected in mating grooves in the other end of said slip, so that when said expanders are moved toward each other, said mating grooves cam said slip to expand and anchor said tool in pipe against upward or downward movement and when said expanders are moved away from each other, said slip contracts.

* * * * *